United States Patent [19]

Gühne et al.

[11] 4,052,765

[45] Oct. 11, 1977

[54] VACUUM CLEANER

[75] Inventors: Wieland Gühne, Remscheid; Klaus Hoffmann, Haan, both of Germany

[73] Assignee: Vorwerk & Co. Elektrowerke GmbH & Co. KG, Wuppertal, Germany

[21] Appl. No.: 639,231

[22] Filed: Dec. 10, 1975

[30] Foreign Application Priority Data

Dec. 21, 1974 Germany ..... 2460863

[51] Int. Cl.[2] ..... A47L 5/24; A47L 9/22

[52] U.S. Cl. ..... 15/344; 15/413; 417/367; 417/368

[58] Field of Search ..... 15/413, 344; 417/366, 417/367, 368

[56] References Cited

U.S. PATENT DOCUMENTS 2,321,126 6/1943 Breuer ..... 417/367

*Primary Examiner*—Christopher K. Moore
*Attorney, Agent, or Firm*—Michael J. Striker

[57] ABSTRACT

A housing in a vacuum cleaner is subdivided into a first space and a separate second space which does not communicate with the first space but is in heat-exchanging relationship with the first space. An impeller is located in the second space for sucking dust-laden air into one end of the second space and discharging it out the other. The drive motor for the impeller means is located in the first space. Thus, the drive means is not contacted by the dust-laden air passing through the second space but is nevertheless cooled by such dust-laden air.

18 Claims, 8 Drawing Figures

VACUUM CLEANER

BACKGROUND OF THE INVENTION

The invention relates to vacuum cleaners, particularly hand-held vacuum cleaners.

More particularly, the invention relates to vacuum cleaners of the type in which the space accommodating the drive motor is separate from the interior of the blower unit, so that the dust-laden air passing through the blower unit will not contact the drive motor.

Vacuum cleaners of this general type are known. It is known to take the housing frame of such a vacuum cleaner and spray it around with hard foam material, the outer skin being made of a flexible material. At the same time, the motor and the blower unit are secured onto the housing frame and encased in hard foam material. The foam material in the vicinity of the air discharge outlet should be of larger pore size than elsewhere, in order to permit the sound-muffled and filtered air to leave the housing at this location.

This known expedient is disadvantageous. Despite the purification of the air by means of a filter bag, fine dust particles are carried along and pass, together with the motor cooling air, over the drive motor. Because the large-pore-sized foam of the discharge outlet region of the housing acts as a supplemental after-connected filter, these fine particles become deposited in the interstices between the foam pores and gradually damp the through-flow of air. This action adds to the already present disadvantage that the expedient of direct encasing in foam material impedes the flow of air, to begin with. After a long period of use, the requisite cooling action for the motor no longer occurs.

It is also known to separate the part of the interior space of the housing containing the motor unit from the part containing the blower unit. This is done to separate the dust-laden air flow of the blower unit from the cooling air flow for the motor unit. The motor is provided with a separate impeller for sucking in ambient air, and such air is passed over the motor to cool it and then discharged back into the atmosphere. The air passing through the blower unit, on the other hand, is sucked into the vacuum cleaner housing through an altogether different and independent opening and then discharged therefrom through another opening likewise independent from the discharge opening for the motor cooling air.

A disadvantage of this known expedient is that cool ambient air must be continually sucked into contact with the motor and then, after it becomes heated as a result of such contact and laden with carbon dust discharged from the motor, returned to the outside. Additionally, this system can be used in vacuum cleaners only when inlet filters are employed.

SUMMARY OF THE INVENTION

It is a general object of the invention to provide a sound-muffled vacuum cleaner in which the space for the motor unit is separate from the space for the blower unit, but wherein the cooling of the motor unit does not necessitate the continual sucking of cool ambient air into contact with the motor followed by its return to the outside.

It is another object to resort to a closed-volume closed flow circuit for the motor cooling air, with the circulating air in this closed flow circuit being continually regenerated and cooled.

These objects, and others which will become more understandable from the description, below, of a preferred embodiment, can be met, according to one advantageous inventive concept by providing separate non-communicating spaces for the blower unit and for the motor unit, with the spaces being in heat-exchanging relationship with each other. In this way, the dust-laden air passing through the blower unit space does not contact the motor unit in the motor unit space, but nevertheless serves to cool the air in the motor unit space and thereby the motor itself.

According to a further concept of the invention, the motor unit space has the form of air passages together forming a closed flow circuit for continually recirculated cooling air, with heat-exchanging means being provided for effecting a transfer of heat from the air in the motor unit space to the dust-laden air travelling through the blower unit space, and with dust-removing means being provided for continually removing from the air in the motor unit space the carbon dust being discharged by the motor into such air during motor operation.

To make it possible for the vacuum cleaner housing to be closed on all sides and open only where the dust-laden air is to be sucked in and discharged, the closed flow circuit for the motor cooling air is separated from the ambient atmosphere and has no communication with it, with the air flow in the closed flow circuit being a fixed-volume forced flow. It should be noted that the expression closed flow circuit refers to the interconnection of the cooling passages, i.e., that they formed a loop around which air can flow; the word closed in the expression closed flow circuit does not of itself indicate that the flow circuit is to have no communication with the ambient environment, although this is in fact preferred.

Advantageously, the heat exchange between the dust-laden air travelling through the blower unit and the motor cooling air travelling in the cooling air circuit is effected by means of cooling fins or projections provided on the external skin of the blower unit, preferably of one piece with such external skin.

An electric motor having carbon brushes, or the equivalent, continuously discharges fine carbon dust during its operation. If the space containing the motor unit has the form of a closed flow circuit, and if it is desired to continually remove the carbon dust from the air circulating in such circuit, then it is contemplated according to the invention to provide dust-removing means including two distinct parts. One part is provided on the motor cooling-air impeller itself and has the form of catching surfaces and/or structures for catching and collecting the fine carbon dust. The other part is preferably a filter arrangement located downstream of the motor unit, for catching and collecting the fine dust not caught by the dust-removing means on the cooling-air impeller.

Advantageously, the filter arrangement does not block the cooling-air circulation; i.e., the circulating cooling air is not constrained to pass through the filter arrangement. Instead, the filter arrangement is located alongside the flowing cooling air, so located that the warmed and carbon-dust-laden air discharged by the cooling-air impeller of the motor unit directly impinges upon the filter arrangement, without actually having to pass through the filter arrangement. This affords the advantage of dust filtration, without increasing the flow resistance against which the motor unit need work.

Also to avoid unnecessary loading of the motor unit, the air passages forming the closed flow circuit upstream and downstream of the motor have cross-sectional areas such and include bends so few in number and dull in shape as to minimize the resistance to air flow.

Advantageously, the separation of the warm air passage or passages (those located upstream of the main heat-exchanging means) from the cool air passage or passages (those located downstream of the main heat-exchanging means) is effected by means of separating surfaces or edges molded integral with the exterior surface of the blower unit and/or the interior surface of the housing accommodating the blower unit and the drive unit.

In order that the heat-exchanging effect be as great as possible, it is contemplated not merely to provide cooling fins or the like on for example the main housing of the blower unit, but even to make the inlet and outlet conduits of the blower unit of thermally conductive material so that heat exchange can occur as between air inside and surrounding them too. Furthermore, it is contemplated to have all heat-exchanging surfaces of the blower unit in thermally conductive connection with one another as well.

The carbon dust discharged by the electric drive motor should be removed from the circulating air in the closed cooling-air flow circuit as near as possible to the point at which it enters the flow, i.e., as near as possible to the point of discharge from the motor. This is to prevent the uncontrolled development of deposits of carbon dust along the surfaces bounding the cooling-air flow circuit, and especially to prevent such deposits upon the heat-exchanging fins and other heat-exchanging surfaces since such deposits could detract from the cooling action. Therefore, according to the invention, it is preferred that the carbon dust removing means be provided directly adjacent the warm air discharge location of the motor unit.

The means for removing the carbon dust should remove it from the cooling air passing over the warm surfaces of the motor. To this end, the invention further contemplates providing the motor-unit cooling-air impeller itself with means, on the radially outward extending blades of the impeller, for catching and collecting carbon dust. Preferably, such means has the form of a collar which connects together the outer ends of the blades, with the collar having an angled transverse cross-sectional configuration. The collar can have a deflector portion and a collector portion, for respectively guiding carbon-dust-laden air and collecting carbon dust in the form of a growing deposit. Advantageously, the deflector portion extends generally parallel to the air travel direction whereas the collector portion is arranged relative thereto at an angle of at least 90°. Advantageously, the cooling-air impeller blades are provided with dust collecting recesses capable of accumulating a considerable deposit of carbon dust.

The just-described means on the motor unit cooling-air impeller by itself will not suffice to remove all the carbon dust in the circulating cooling air. Accordingly, the invention contemplates the use of a supplemental filter arrangement. Advantageously, the supplemental filter arrangement is one through which the circulating cooling air need not actually pass, but against which the cooling air will merely impinge.

One advantage that can be achieved utilizing various ones of the aforementioned inventive concepts is the formation of a completely closed housing around the motor and blower units, it being possible to make the housing of elastic material. If the motor unit space is a closed flow circuit for circulating cooling air, and if it is furthermore at no point in communication with the exterior of the housing, then the noise of the motor can be muffled to a very considerable extent, although it becomes necessary to continually remove the discharged carbon dust from the cooling-air circuit.

Another advantage resulting from the use of various ones of the aforementioned inventive concepts is that the dimensions of the vacuum cleaner can be kept quite small, especially when the blower unit passage for dust-laden air passes through but does not communicate with the closed circuit for cooling air.

Also, when a closed flow circuit not communicating with the housing exterior is employed, the operation of the vacuum cleaner is by comparison with similar older designs more hygienic, inasmuch as the carbon dust discharged by the electric drive motor during vacuum cleaner operation will not be discharged into the air in the room being cleaned.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
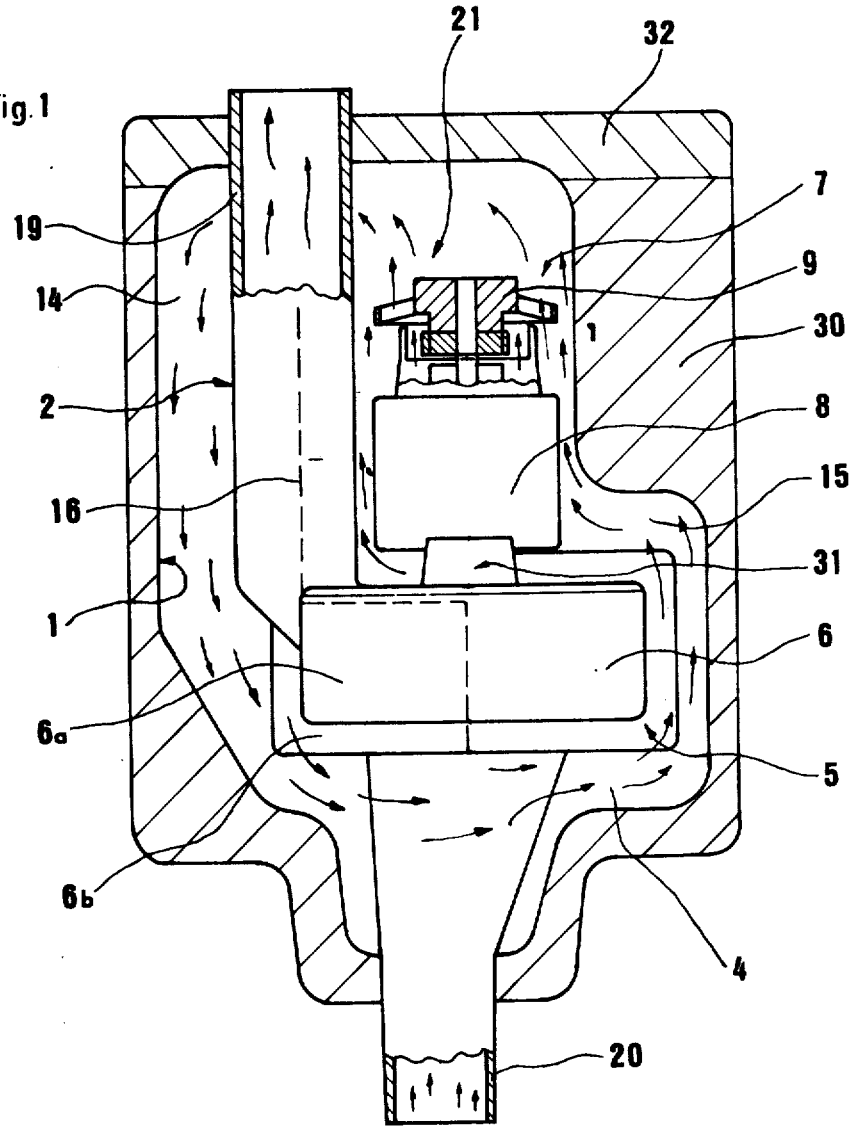
FIG. 1 is a longitudinal section through the main housing of vacuum cleaner, showing the closed flow circuit for the cooling air for the motor unit, the heat-exchange arrangement and the carbon-dust-removing arrangement.
Figure 2:
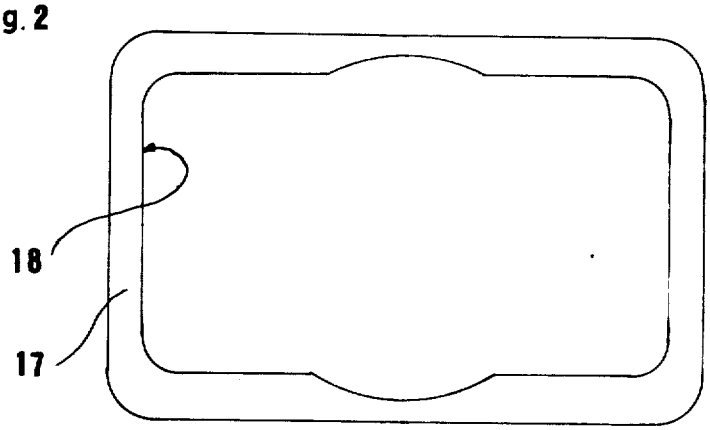
FIG. 2 is a plan view of the elastic-material housing of FIG. 1, with the blower unit and motor unit removed.

FIG. 1 depicts a vacuum cleaner housing 30 closed on all sides and provided with a matching cover 32. The interior 12 of the vacuum cleaner housing 30 contains the working aggregate 31 of the vacuum cleaner, including a motor unit 8 and a blower unit. The blower unit is comprised of a blower housing 6 containing a (non-illustrated) impeller, an inlet or suction conduit 20, and an outlet or discharge conduit 19.

The motor unit 8 is located outside of the blower unit, so that the dust-laden air sucked into the blower unit at 20 and discharged (for instance into a dust receptacle) from 19 does not reach the motor unit 8. In other words, the interior 12 of housing 30 is divided into a first space and a second space which passes through the first space but does not communicate with the first space. The second space is constituted by the interior of the blower unit, including the interior of the inlet conduit 20, blower housing 6 and outlet conduit 19. The first space is the space inside housing 1 surrounding the blower unit and containing the motor unit 8.

The exterior surfaces of the blower unit and the interior surfaces 1 of the housing together define a closed flow circuit 4 for the circulation of cooling air for the motor unit 8. The closed flow circuit 4 surrounds the blower unit and does not communicate with the exterior of the vacuum cleaner housing.

Blower housing 6 is provided with a plurality of cooling fins together forming a heat-exchanging arrangement 5. The portion of the closed flow circuit 4 downstream of the heat-exchanging arrangement 5 constitutes a cold air passage 15, whereas the portion of the closed flow circuit 4 upstream of the heat-exchanging arrangement 5 constitutes a warm air passage 14.

Figure 3:
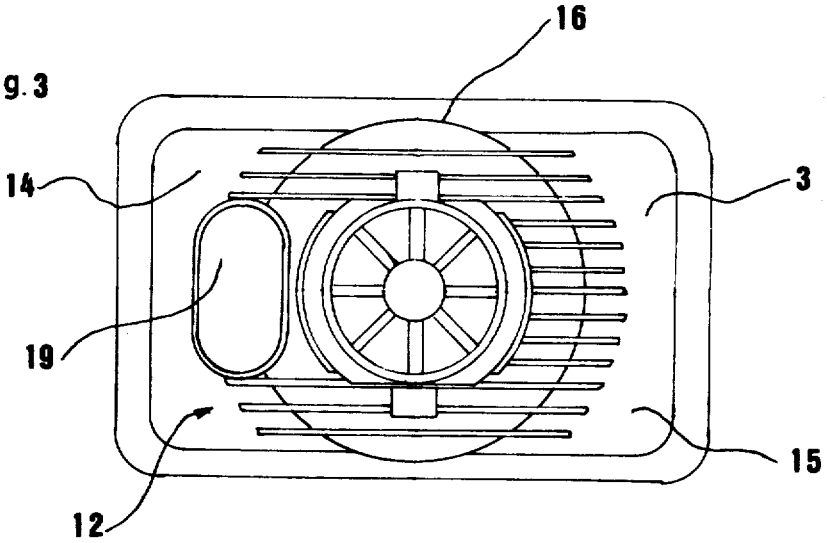
FIG. 3 is a view corresponding to FIG. 2, but with the blower unit and motor unit inserted in place, showing how surfaces of the housing interior and surfaces of the exterior of the blower unit cooperate to separate the interior of the housing into two air passage sections.

The direction of flow of cooling air in closed flow circuit 4 is indicated by the counterclockwise travelling arrows. The path taken by the air is determined in part by separating edges or surfaces 16 molded integral with the material of the interior of the housing and/or the exterior of the blower unit. In FIG. 1, a broken line is provided to show where the separating edge or surface 16 establishes a separation between the warm and cool air passages. In FIG. 3, which shows the blower unit in place in the housing, it will be seen that separating surfaces 16 of the blower unit and housing contact each other, to subdivide the space surrounding the blower unit into the warm and cool air passages 14 and 15. There can be additional engagement of this type along the outlet conduit 19, as indicated by the upper portion of the broken line in FIG. 1. For example, the outlet conduit 19 could be provided with outwardly extending fins corresponding to the upper portion of the broken line at 16, with edges of these fins bearing against the inner surface of the housing and constituting separating surfaces or edges.

The motor unit 8 is provided with an impeller 9 in addition to the (non-illustrated) impeller located inside the blower housing 6. Both impellers are driven by the motor unit 8, but it is clear that impeller 9 is located in the first space whereas the (non-illustrated) impeller of the blower unit is located in the second space.

The impeller 9 serves to maintain the cooling air in the closed flow circuit 4 in continuous circulation during operation of motor unit 8.

As cooling air circulates in circuit 4, driven by impeller 9, it passes over the cooling fins 6*b* on the exterior 6*a* of the blower housing 6, so that the heat imparted to the cooling air by the motor unit 8 will in turn be imparted to the dust-laden air passing through the blower unit 20, 6, 19. To maximize the heat-exchanging efficiency, heat exchange occurs not only at the cooling fins 6*b* but additionally all along the surfaces of inlet conduit 20 and outlet conduit 19, and also all along the surface 6*a* of blower housing 6. To this end, the conduits 19, 20 and the housing 6 are preferably all made of a thermally conductive material, such as a metal, and are all connected to one another in thermally conductive manner.

The flow circuit 4 defined by the interior surface 1 of the housing and the exterior surface of the blower unit does not communicate with the exterior of the housing. As a result, the continuously recirculated air in circuit 4 must not only be continuously cooled, but also continuously regenerated. This is because carbon dust is continuously discharged from the carbon brushes of the electric motor of motor unit 8. If this carbon dust is not removed, it may interfere with motor operation. In any event, it would deposit itself upon the walls of the cooling-air circuit 4 and in particular on the aforedescribed heat-exchanging surfaces, thereby reducing the cooling action for the motor unit 8.

To continually remove such discharged carbon dust from the motor cooling air in circuit 4, use is made of dust-removing means including means 7 on the cooling-air impeller 9 itself and further filter means 11, explained with reference to FIG. 5.

Figure 5:
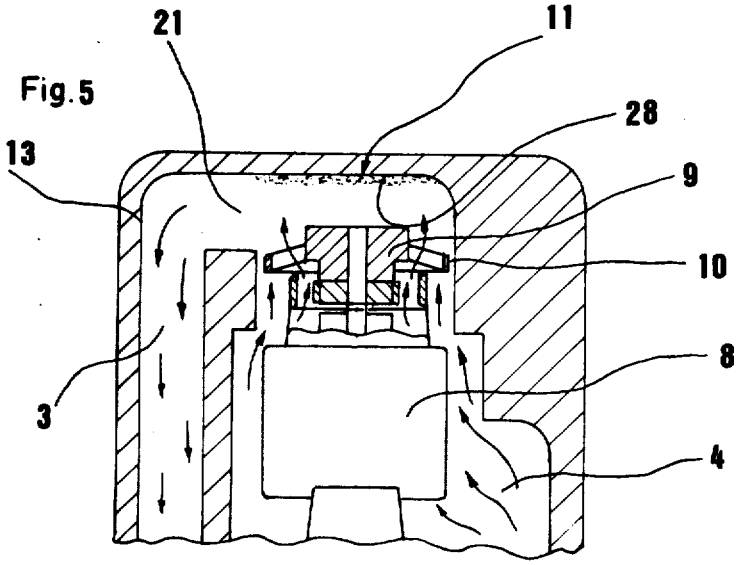
FIG. 5 depicts a portion of the arrangement of FIG. 1 on a somewhat greater scale, showing in greater detail the carbon dust separating arrangement on the motor and the impingement filter on the wall of the cooling-air flow circuit.

FIG. 5 shows the arrangement of FIG. 1, on a larger scale. The cooling air passes over the motor unit 8, driven around circuit 4 by cooling-air impeller 9. The impeller 9 is located so as to be as close as possible to the place from which the carbon dust from the motor carbon brushes is discharged. Means is provided on the impeller 9 itself to catch and collect a great part of the discharged carbon dust, before such carbon dust can reach the aforedescribed heat-exchanging surfaces; the dust collecting means on impeller 9 will be discussed below, in connection with FIGS. 6 – 8.

However, the dust removing means 7 on impeller 9 itself is not sufficient to remove all the discharged carbon dust. Accordingly, there is provided, just downstream of cooling-air impeller 9 a filter arrangement 11. The filter arrangement 11 is advantageously comprised of a body of porous material implanted in the wall of the flow circuit 4. However, instead of using a discrete filter body, it would be possible to simply make the wall of the flow circuit 4 of large-pore porous character at at least this location, i.e., by suitable choice of the composition of the surface portion 18 of the walling 17 of the housing.

Filter arrangement 11 is arranged at an impingement location 28 such that the incompletely cleaned carbon-dust-laden air discharged by cooling-air impeller 9 will impinge directly against the filter arrangement 11. The residual carbon dust in this cooling air will be trapped in the porous structure of filter arrangement 11, so that the cooling air downstream of the filter arrangement will be substantially carbon-dust-free, thereby presenting no threat to the heat-exchanging surfaces.

An important advantage of so positioning the filter arrangement 11 is that the cooling air is not actually constrained to pass through the filter arrangement; instead it is merely discharged against the filter arrangement. This serves to avoid an increase in the flow resistance of the circuit 4, and thereby minimize the loading on motor unit 8 attributable to the maintenance of the cooling air in circulation. For the same reason, the cross-sectional area of the warm and cool air passages 14, 15 is selected so great, and the number and sharpness of the bends 13 so low as not to significantly add to the flow resistance of the cooling-air flow circuit 4.

Figure 6:
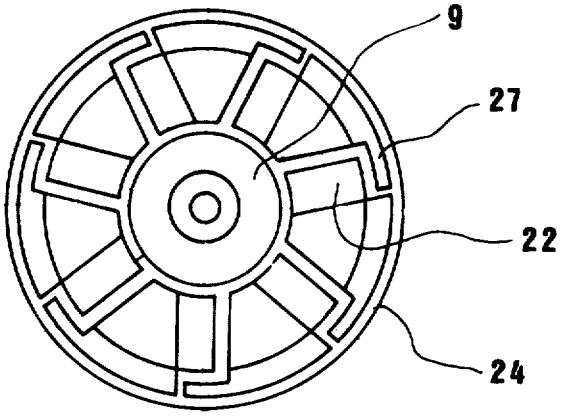
FIG. 6 is a top view of the motor unit cooling-air impeller, provided with means for catching and collecting carbon dust discharged by the motor during its operation.
Figure 7:
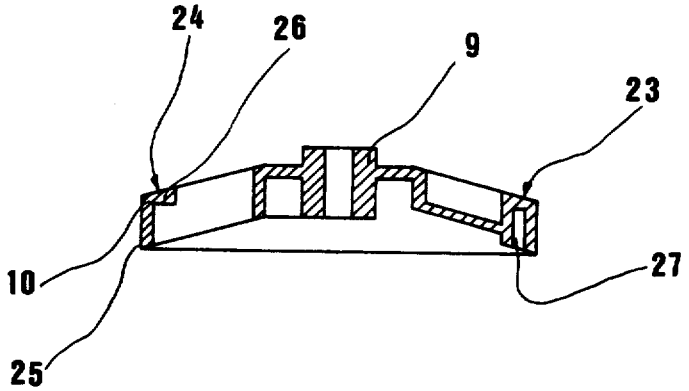
FIG. 7 is a transverse section through the impeller of FIG. 6, showing clearly the catching and separating portions.
Figure 8:
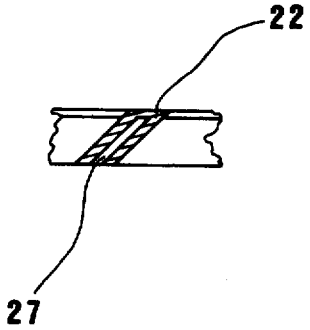
FIG. 8 is a detail of the impeller, showing the size and orientation of one of the dust-collecting recesses on the radial outer end of an impeller blade.

The principal carbon-dust-removing means is provided on the cooling-air impeller 9 itself, as shown in FIGS. 6, 7 and 8.

Cooling-air impeller 9 is provided at the radially outward ends 23 of its impeller blades with a collar or ring 24. Ring 24 is of angled transverse cross-sectional configuration. The junction of the blade ends 23 and collar 24 is provided with dust-catching recesses 27. When the motor unit 8 operates, the cooling-air impeller 9 will turn at motor speed, and the warmed and carbon-dust-laden cooling air will move through the blades 22. The rotation of the blades will cause the dust particles of larger size to be accelerated radially outward, by centrifugal force. Such larger carbon dust particles impact against the guide portion 25 of the collar and are held thereagainst by centrifugal force. Meanwhile, the axially travelling air stream causes these carbon dust particles to slide axially along guide portion 25 towards collecting portion 26 of collar 24, where they very gradually form a deposit.

To maximize the dust-catching and -collecting efficiency, the cooling-air impeller 9 is additionally provided with deep dust-collecting recesses 27 (see FIG. 8).

Figure 4:
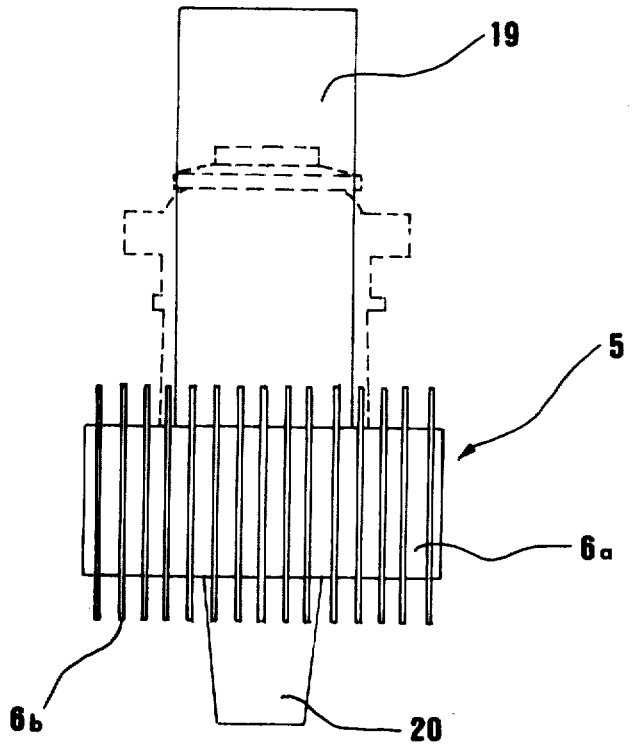
FIG. 4 shows the heat-exchanging or cooling fins mounted on the blower unit housing and also the heat-exchanging inlet and outlet conduits of the blower unit.

As shown particularly clearly in FIG. 4, the cooling fins 5*b* of the heat-exchanging-arrangement 5 are disposed with such an orientation as to present the least possible resistance to air flow, again to minimize the load placed upon motor 8 in driving cooling-air impeller 9.

It will be understood that each of the elements described above, or two or more together, may also find a useful application in other types of constructions differing from the types described above.

While the invention has been illustrated and described as embodied in a vacuum cleaner, particularly a hand-held vacuum cleaner, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a vacuum cleaner, particularly a hand-held vacuum cleaner, in combination, a housing; a blower unit in the housing, said blower unit forming a flow path for the passage of dust-laden air through said housing; a motor unit in the housing in driving relation with said blower unit, the motor unit being located in the housing in a motor unit space separate from the flow path formed by the blower unit so that dust in the dust-laden air passing through the blower unit is prevented from reaching the motor unit, the motor unit space being jointly defined by the internal surfaces of the housing and the external surfaces of the blower unit, the motor unit space having the form of air conduits forming a closed flow circuit for cooling air and containing the motor unit; heat-exchanging means for effecting an exchange of heat between the air in the motor unit space and the air passing through the blower unit; and dust-removing means for removing from the air in the motor unit space carbon dust discharged into such air by the motor unit during operation of the latter.

2. In a vacuum cleaner as defined in claim 1, wherein the motor unit space does not communicate with the exterior of the housing, and further including means for establishing a forced flow of circulating cooling air in the closed flow circuit constituted by the motor unit space.

3. In a vacuum cleaner as defined in claim 1, wherein the heat-exchanging means is comprised of heat-exchanging projections on the exterior of the blower unit.

4. In a vacuum cleaner as defined in claim 1, wherein the motor unit includes an impeller located in the motor unit space for establishing a forced flow of circulating cooling air in the closed flow circuit constituted by the motor unit space, and wherein the dust-removing means includes means on the impeller for catching and collecting carbon dust in the circulating cooling air and filter means located in the path of the circulating cooling air for catching and collecting impurities not caught and collected by the means on the impeller.

5. In a vacuum cleaner as defined in claim 4, wherein the filter means is so located relative to the air discharged by the impeller of the motor unit as to be impinged upon by such discharged air.

6. In a vacuum cleaner as defined in claim 4, wherein the impeller of the motor unit has radially outward extending blades, and wherein the dust-removing means on the impeller comprises an annular collar connecting together the radially outmost portions of the blades, the annular collar having an angled transverse cross-sectional configuration.

7. In a vacuum cleaner as defined in claim 6, wherein the collar includes a deflecting portion for deflecting dust and a collecting portion for collecting the deflected dust.

8. In a vacuum cleaner as defined in claim 7, wherein the deflecting portion extends generally parallel to the direction of air flow, and wherein the collecting portion is displaced relative to the such direction by at least 90°.

9. In a vacuum cleaner as defined in claim 6, wherein the blades are provided with dust collecting cavities.

10. In a vacuum cleaner as defined in claim 4, wherein the filter means is constituted by a porous dust-collecting portion of one of the aforementioned surfaces, the dust-collecting portion being so located as to be impinged upon by the dust-laden air discharged by the impeller of the drive unit and then deflect such air without the dust-collecting portion actually blocking the flow cross-section of the closed flow circuit.

11. In a vacuum cleaner as defined in claim 1, wherein the cross-sectional area of and the number of bends in the portions of the closed flow circuit upstream and downstream of the motor unit are such as to minimally load the motor unit.

12. In a vacuum cleaner as defined in claim 1, wherein the portion of the closed flow circuit upstream of the heat-exchanging means is separated from the portion downstream of the heat-exchanging means by at least one separating portion constituted by at least one molded integral portion provided with at least part of at least one of the aforementioned surfaces.

13. In a vacuum cleaner as defined in claim 12, wherein the surfaces bounding these portions of the closed flow circuit located upstream and downstream of the heat-exchanging means are smooth surfaces.

14. In a vacuum cleaner as defined in claim 1, wherein the blower unit has an outlet conduit of thermally conductive material passing through the interior of the housing and serving to effect further heat exchange between the air in the motor unit space and the air travelling through the blower unit.

15. In a vacuum cleaner as defined in claim 1, wherein the blower unit has an inlet conduit of thermally conductive material passing through the interior of the housing and serving to effect further heat exchange between the air in the motor unit space and the air travelling through the blower unit.

16. In a vacuum cleaner as defined in claim 1, wherein the blower unit has inlet and outlet conduits of thermally conductive material and a blower unit housing of thermally conductive material intermediate the inlet and outlet conduits, and wherein the inlet and outlet conduits and blower unit housing are connected to one another in heat-exchanging relationship.

17. In a vacuum cleaner, particularly a hand-held vacuum cleaner, in combination means defining a first air passage forming a closed circuit for air and a second air passage which extends through the first passage in heat-exchanging relationship therewith but does not communicate with the first passage; impeller means in the second passage for sucking dust-laden air into one end of the second passage and discharging the dust-laden air from the other end of the second passage; an electric drive motor in the first passage connected to the impeller means in the second passage for driving the impeller means; additional impeller means in the first passage also driven by the drive motor for establishing in the first passage a flow of circulating air, to effect cooling of the drive motor by virtue of the heat exchange between the air travelling in the second passage and the air travelling in the first passage; and means operative during drive motor operation for continually removing from the air circulating in the first passage carbon dust discharged into such air by the electric drive motor.

18. In a vacuum cleaner, particularly a hand-held vacuum cleaner, in combination, housing means defining a first space and a separate second space which is surrounded by but does not communicate with the first space; impeller means in the second space for sucking dust-laden air into one end of the second space and discharging it out the other; drive means for driving the impeller means, the drive means being located in the first space so as not to be contacted by the dust-laden air passing through the second space but so as to be nevertheless cooled by such dast-laden air; and heat-exchanging means for effecting an exchange of heat between the air in the first space and the impelled air in the second space.

* * * * *